US011077380B1

(12) United States Patent
Tiefel

(10) Patent No.: US 11,077,380 B1
(45) Date of Patent: Aug. 3, 2021

(54) BI-STABLE JUMPING TOY AND ITS ASSOCIATED METHOD OF OPERATION

(71) Applicant: Doozi, LLC, Burlington, NJ (US)

(72) Inventor: Simeon E. Tiefel, Siloam Springs, AR (US)

(73) Assignee: Doozi, LLC, Burlington, NJ (US)

( * ) Notice: Subject to any disclaimer, the term of this patent is extended or adjusted under 35 U.S.C. 154(b) by 0 days.

(21) Appl. No.: 17/131,095

(22) Filed: Dec. 22, 2020

(51) Int. Cl.
*A63H 11/06* (2006.01)
*A63H 37/00* (2006.01)
*A63H 33/00* (2006.01)

(52) U.S. Cl.
CPC ..... *A63H 11/06* (2013.01); *A63H 33/00* (2013.01); *A63H 37/005* (2013.01)

(58) Field of Classification Search
CPC ..... A63H 33/00; A63H 37/005; A63H 11/06; A63F 9/28
See application file for complete search history.

(56) References Cited

U.S. PATENT DOCUMENTS 1,362,248 A 12/1920 Ford
1,384,046 A 7/1921 Carrino
2,297,759 A 10/1942 Fornas
2,535,868 A * 12/1950 Roberts ..... A63H 11/06 446/311
2,776,525 A * 1/1957 Ford ..... A63H 11/06 446/199
3,378,947 A * 4/1968 Zimmerman ..... A63H 33/00 446/311
3,526,991 A 9/1970 Goldfarb et al.
4,138,797 A * 2/1979 Stolar ..... A63F 9/28 273/127 D
4,363,184 A 12/1982 Marcolina
5,038,532 A * 8/1991 Shahinpoor ..... E04B 1/3441 52/109
6,086,449 A * 7/2000 Sharp ..... A63H 33/103 446/308
7,803,033 B1 9/2010 Walterscheid
9,095,781 B2 8/2015 Tiefel et al.
9,212,863 B1 * 12/2015 Weinstock ..... A63F 9/0278
10,006,195 B2 * 6/2018 Matsuoka ..... A01K 1/03
2004/0104532 A1 * 6/2004 Ben-Yaakov ..... A63F 3/00697 273/342
2007/0032710 A1 2/2007 Raridan et al.
(Continued)

*Primary Examiner* — Eugene L Kim
*Assistant Examiner* — Alyssa H Hylinski
(74) *Attorney, Agent, or Firm* — LaMorte & Associates, P.C.

(57) ABSTRACT

A bi-stable jumping toy that can be operated individually or with other jumping toys in a cascading chain. The toy has a first segment and a second segment that are joined in a scissor configuration. An elastic band extends between the first segment and the second segment. The elastic band biases the toy into the second configuration. However, the first segment and the second segment can be manually rotated into the stable first configuration. In the first configuration, the elastic band is stretched across the pivot axis and provides no rotational bias to either the first segment or the second segment. The toy is triggered by rotating the first segment and/or the second segment only slightly out of the first configuration. Once moved, the spring energy in the elastic band releases and the toy rapidly moves into its second configuration.

18 Claims, 9 Drawing Sheets

(56) References Cited

U.S. PATENT DOCUMENTS

| | | | | |
|---|---|---|---|---|
| 2008/0166519 | A1* | 7/2008 | Leung | E04B 1/00 428/120 |
| 2008/0233832 | A1 | 9/2008 | Lirot | |
| 2009/0071137 | A1* | 3/2009 | Harris | A63H 29/10 60/325 |
| 2013/0149936 | A1* | 6/2013 | Tiefel | A63H 37/005 446/486 |
| 2014/0232128 | A1 | 8/2014 | Cho | |
| 2014/0273707 | A1* | 9/2014 | Becker | A63H 30/00 446/4 |
| 2015/0089974 | A1* | 4/2015 | Seo | A44C 5/0076 63/1.13 |
| 2017/0144082 | A1* | 5/2017 | Blow | A63H 33/042 |
| 2018/0155922 | A1* | 6/2018 | Matsuoka | E04C 3/02 |

* cited by examiner

BI-STABLE JUMPING TOY AND ITS ASSOCIATED METHOD OF OPERATION

BACKGROUND OF THE INVENTION

1. Field of the Invention

In general, the present invention relates to the structure of toys that jump or pop up from a surface when activated. More particularly, the present invention relates to jumping toys that can be used to create an activation cascade where the activation of one jumping toy triggers the activation of subsequent jumping toys.

2. Prior Art Description

Toys that jump or otherwise pop up into the air from a set position have existed for over a century. In this long history, jumping toys and pop-up toys have been manufactured in numerous shapes, styles and models. The force utilized to make a toy jump typically comes from either a metal spring or an elastic band. The toy is commonly cocked, by compressing the spring or stretching the elastic band. The toy jumps when the energy from the spring or elastic band is released.

In a simple form, toys that jump can be cocked be pressing a spring-loaded component on the toy against a hard surface. The compression of the toy against a surface stores energy in a spring or elastic band. The toy can be triggered simply by releasing the toy. Such prior art jumping toys are exemplified by U.S. Pat. No. 1,362,248 to Ford. To add to the play value of the toy, delay mechanisms are added to the toy that cause the toy to trigger and jump a short time after the toy is cocked. Such delays are often achieved using suction cups that delay a triggering mechanism for the period of time that the suction cup can hold suction. Such prior art toys with suction cup delays are exemplified by U.S. Pat. No. 2,297,759 to Fornas and U.S. Pat. No. 3,526,991 to Goldfarb.

In the science of toy design, there is another commonly used delay mechanism that has been incorporated into jumping toys. This other delay comes from the use of spring-loaded constructs that are bi-stable. That is, the toys are stable both when fully cocked and when fully uncocked. However, should the toy be even slightly moved away from its fully cocked configuration, the toy will become unstable and the stored spring energy will release to move the toy to its fully uncocked configuration. Such bi-stable jumping toys are exemplified by U.S. Patent Application Publication No. 2008/0233832 to Lirot, U.S. Pat. No. 7,803,033 to Walterscheid, and U.S. Pat. No. 9,095,781 to Tiefel. During play, such prior art bi-stable toys are typically cocked into a first stable configuration. When cocked, the toy stores energy. The toy is then thrown or dropped. When the toy strikes another surface, the toy is momentarily deformed. This moves the toy out of its first stable configuration and releases the stored spring energy. The toy then pops into a second stable configuration, wherein the released energy causes the toy to rebound from the surface that was impacted. Manufacturing a toy with such bi-stable characteristics requires precision tooling and often requires the use of metal components.

Although prior art bi-stable toys provide interesting play, there is room for improvement. The present invention is an improved bi-stable toy that can be manufactured easily and inexpensively. Furthermore, the bi-stable toy can be used in a cascade, wherein the triggering of one bi-stable toy can be used to trigger any plurality of subsequent bi-stable toys. The details of the improved bi-stable toy are described and claimed below.

SUMMARY OF THE INVENTION

The present invention is a bi-stable jumping toy that can be operated individually or can be used with other jumping toys in a cascading chain. The bi-stable jumping toy has a first segment and a second segment that are joined in a scissor configuration by a central pivot joint. The first segment and the second segment can rotate about the axis of the pivot joint between a first configuration, where rotation is stopped by contact, and a second configuration, where the opposite rotation is also stopped by contact.

An elastic band extends between the first segment and the second segment. The elastic band biases the first segment and the second segment into their second configuration. However, the first segment and the second segment can be manually rotated into the stable first configuration. In the first configuration, the elastic band is stretched across the pivot axis and provides no rotational bias about the pivot joint to either the first segment or the second segment. The bi-stable jumping toy is triggered by rotating the first segment and/or the second segment only slightly out of the first configuration. Once moved, the spring energy in the elastic band releases and the bi-stable toy rapidly moves into its second configuration. The rapid change in configuration makes the bi-stable toy jump.

A plurality of bi-stable toys can be overlapped into a cascading chain. The first toy in the cascading chain is triggered. The movement of the first toy triggers the next toy in the chain. The process cascades until all the bi-stable toys in the cascading chain trigger.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention jumping toy system can be embodied in many ways, only one exemplary embodiment is illustrated. The exemplary embodiment is being shown for the purposes of explanation and description. The exemplary embodiment is selected in order to set forth one of the best modes contemplated for the invention. The illustrated embodiment, however, is merely exemplary and should not be considered a limitation when interpreting the scope of the claims.

Figure 1:
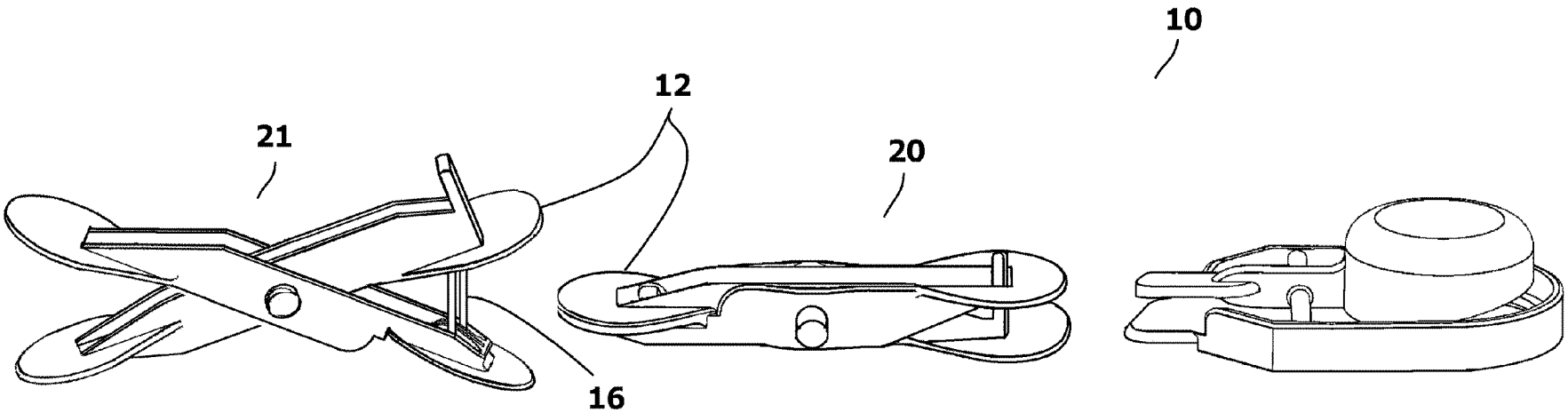
FIG. 1 shows an exemplary embodiment of a jumping toy system consisting of a triggering mechanism and bi-stable assemblies.

Referring to FIG. 1, a jumping toy system 10 is shown. The jumping toy system 10 includes a plurality of bi-stable assemblies 12 and a triggering mechanism 14. As will be explained in detail, each of the bi-stable assemblies 12 contains a spring element, such as an elastic band 16. Furthermore, each of the bi-stable assemblies 12 is stable in both a fully cocked first configuration 20 and a fully uncocked second configuration 21. In the first configuration 20, the elastic band 16 is taut and retains significant spring energy. In the second configuration 21, the elastic band 16 retains no significant spring energy.

Figure 2:
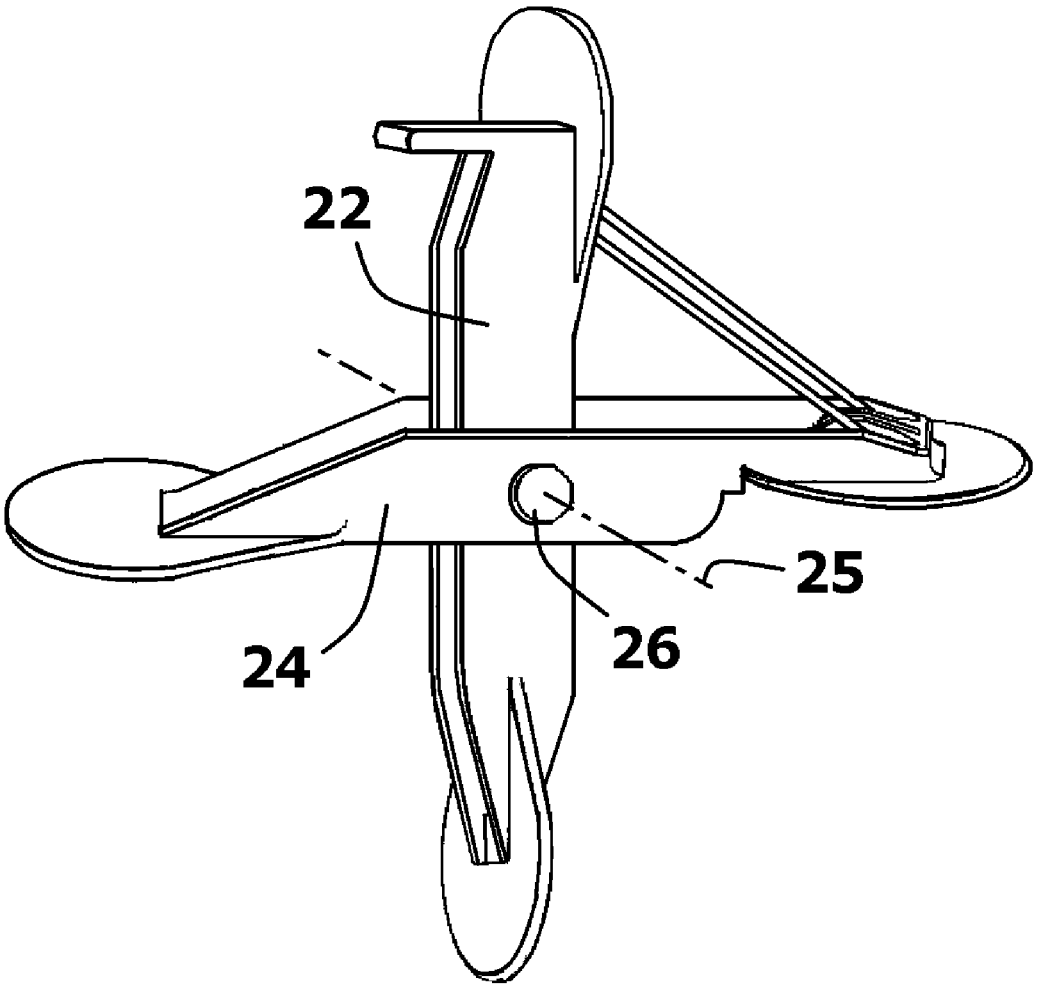
FIG. 2 is a side view of a bi-stable assembly.

Referring to FIG. 2 in conjunction with FIG. 1, it can be seen that each bi-stable assembly 12 includes a first segment 22 and a second segment 24, wherein the first segment 22 and the second segment 24 are separate and distinct. Both the first segment 22 and the second segment 24 are joined at a scissor joint 26. The scissor joint 26 enables rotational movement around a pivot axis 25. As a consequence, both the first segment 22 and the second segment 24 can independently rotate about the pivot axis 25 while remaining interconnected as an assembly.

Figure 3:
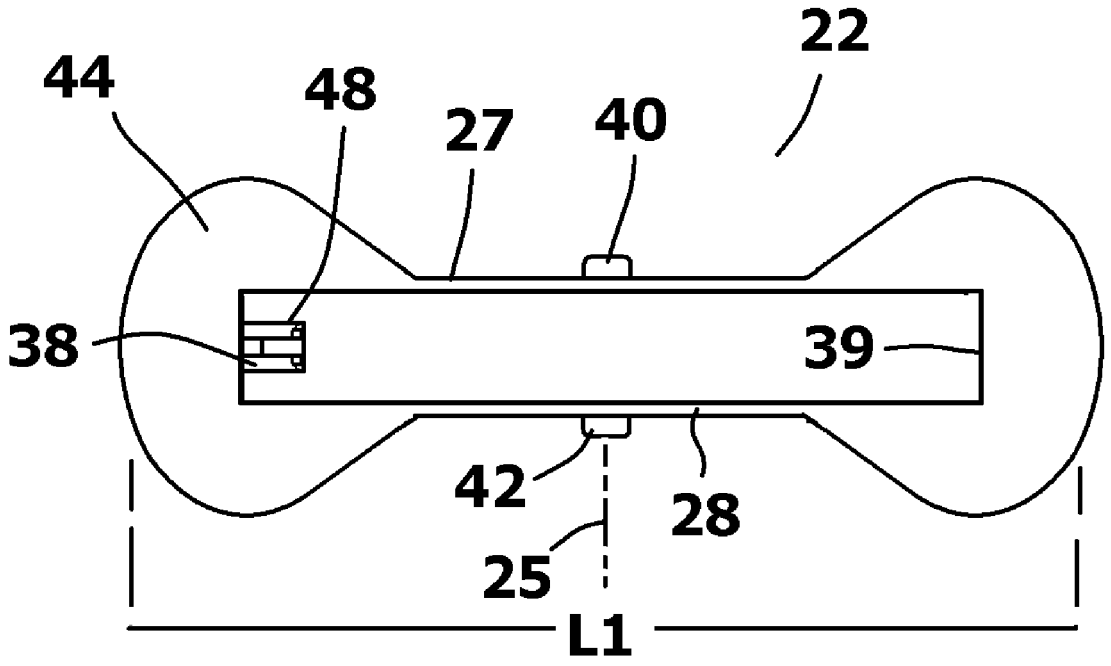
FIG. 3 is a top view of a first element in the bi-stable assembly.
Figure 4:
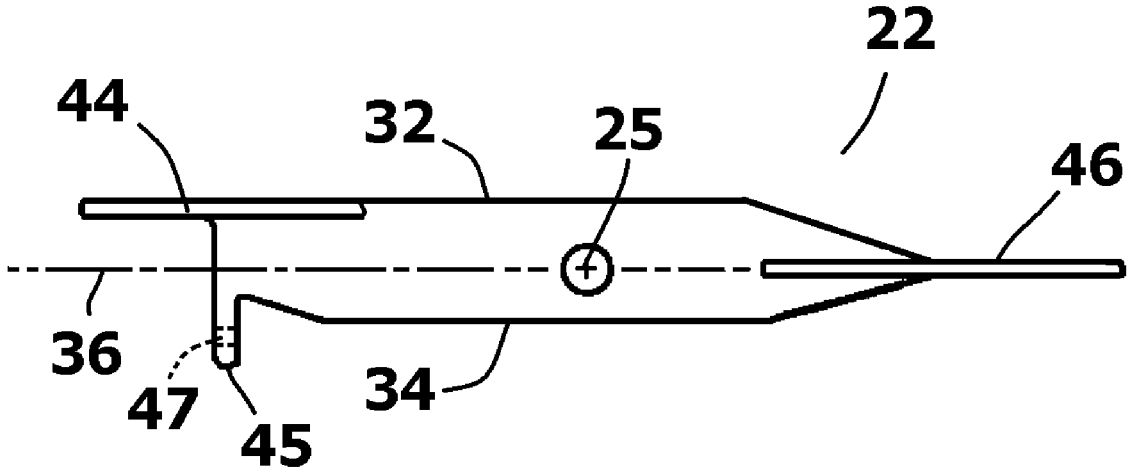
FIG. 4 is a side view of the first element shown in FIG. 3.

Referring to FIG. 3 and FIG. 4, in conjunction with FIG. 2, it can be seen that the first segment 22 has a first length L1. The first segment 22 includes two parallel side walls 27, 28. The side walls 27, 28 are spaced apart and define opposite parallel sides of a first open slot 30. Each of the sidewalls 27, 28 has a top edge 32, a bottom edge 34, and a midline 36 that is halfway between the top edge 32 and the bottom edge 34. The first open slot 30, defined by the sidewalls 27, 28, extends between a first end 38 and an opposite second end 39. Two pivot pins 40, 42 extend outwardly from the side walls 27, 28 at a perpendicular. The pivot pins 40, 42 extend from the midline 36 of the side walls 27, 28 and are concentric with the pivot axis 25 of the scissor joint 26.

A wide first flange 44 extends outwardly from the first end 38 of the first open slot 30. The first flange 44 is flat and extends in a plane that is perpendicular to the side walls 27, 28. As such, the plane of the first flange 44 is parallel to the midline 36 of the sidewalls 27, 28. Although parallel, the first flange 44 is not aligned with the midline 36 of the side walls 27, 28. Rather, the plane of the first flange 44 aligns with the top edge 32 of the side walls 27, 28.

A wide second flange 46 extends outwardly from the second end 39 of the first open slot 30. The second flange 46 is flat and extends in a plane that is perpendicular to the side walls 27, 28. As such, the plane of the second flange 46 is parallel to the midline 36 of the side walls 27, 28. Furthermore, the second flange 46 is coplanar with the midline 36 of the side walls 27, 28. As such, the plane of the second flange 46 is parallel to, but offset from, the plane of the first flange 44.

A first anchor hook 48 is provided that extends into the first open slot 30 from the first end 38 of the first open slot 30. The anchor hook 48 is used to engage the elastic band 16, as is later explained. Additionally, an optional post 45 may extend below the bottom edge 34 of the sidewalls 27, 28. The post contains a hole 47 that is is used to secure the bi-stable assembly 12 is its cocked first configuration 20, as is later explained.

Figure 5:
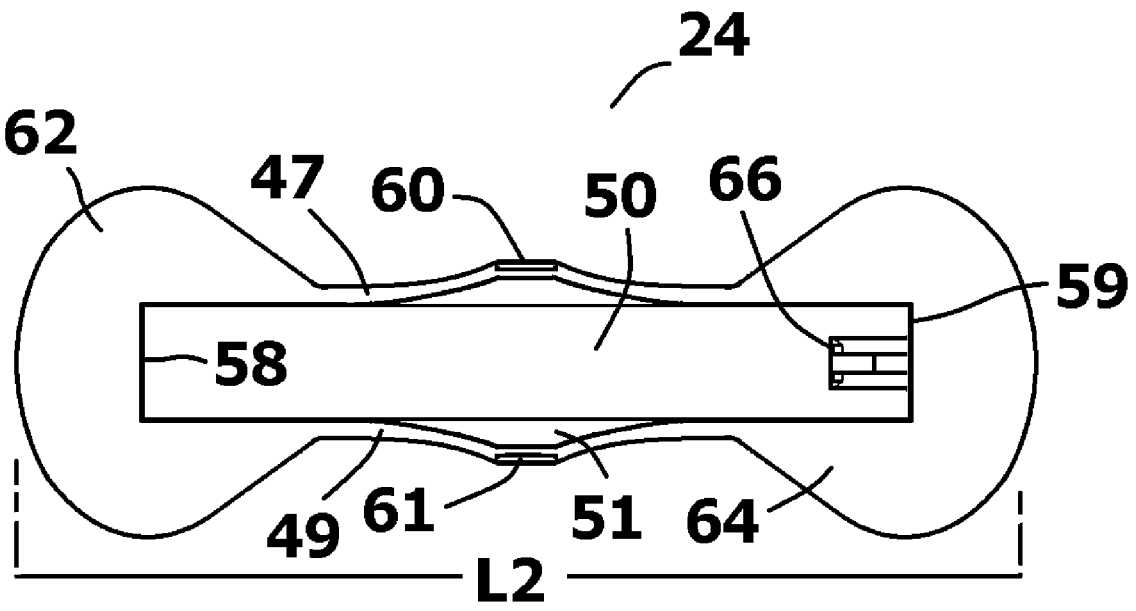
FIG. 5 is a top view of a second element in the bi-stable assembly.
Figure 6:
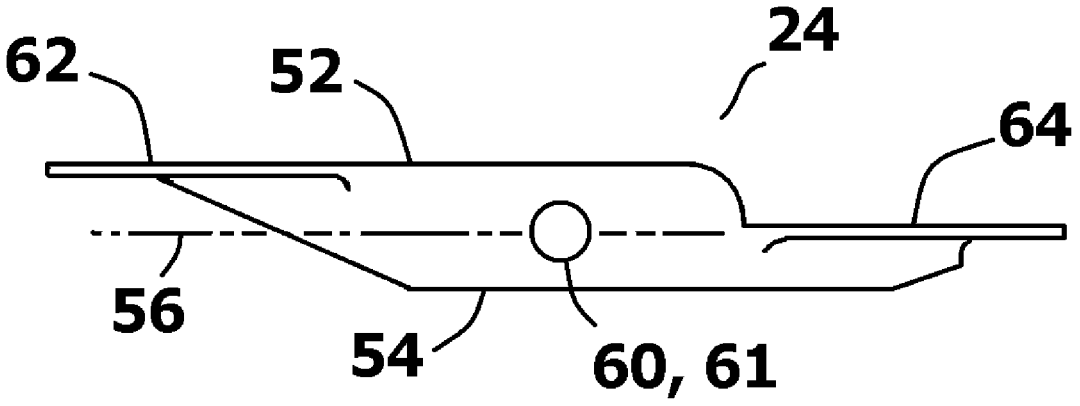
FIG. 6 is a side view of the second element shown in FIG. 5.

Referring to FIG. 5 and FIG. 6, in conjunction with FIG. 2, it can be seen that the second segment 24 has a second length L2. The second length L2 of the second segment 24 is equal to the first length L1 of the first segment 22. The second segment 24 includes two side walls 47, 49. The side walls 47, 49 are spaced apart and define opposite parallel sides of a second open slot 50. The side walls 47, 49 can be flared to create a saddle receptacle 51. The saddle receptacle can be used to retail a secondary object, such as a ball, as is later explained. Each of the side walls 47, 49 includes a top edge 52, a bottom edge 54, and a midline 56 that is halfway between the top edge 52 and the bottom edge 54. The second open slot 50 defined by the side walls 47, 49 extends between a first end 58 and an opposite second end 59. Two pivot holes 60, 61 are formed in the side walls 47, 49. The pivot holes 60, 61 are concentric with the pivot axis 25 of the scissor joint 26.

A wide third flange 62 extends outwardly from the first end 58 of the second open slot 50. The third flange 62 is flat and extends in a plane that is generally perpendicular to the side walls 47, 49. As such, the plane of the third flange 62 is parallel to the midline 56 of the side walls 47, 49. Although parallel, the third flange 62 is not aligned with the midline of the side walls 47, 49. Rather, the plane of the third flange 62 aligns with the top edge 52 of the side walls 47, 49.

A wide fourth flange 64 extends outwardly from the second end 59 of the second open slot 50. The fourth flange 64 is flat and extends in a plane that is parallel to the third flange 62. As such, the plane of the fourth flange 64 is parallel to the midline 56 of the side walls 47, 49. Furthermore, the fourth flange 64 is coplanar with the midline 56 of the side walls 47, 49. As such, the plane of the fourth flange 64 is parallel to, but offset from, the plane of the third flange 62.

A second anchor hook 66 is provided that extends into the second open slot 50 from the second end 59 of the second open slot 50. The second anchor hook 66 is used to engage the elastic band 16. The elastic band 16 is stretched between the second anchor hook 66 on the second segment 24 and the first anchor hook 48 on the first segment 22, as is later explained.

Figure 7:
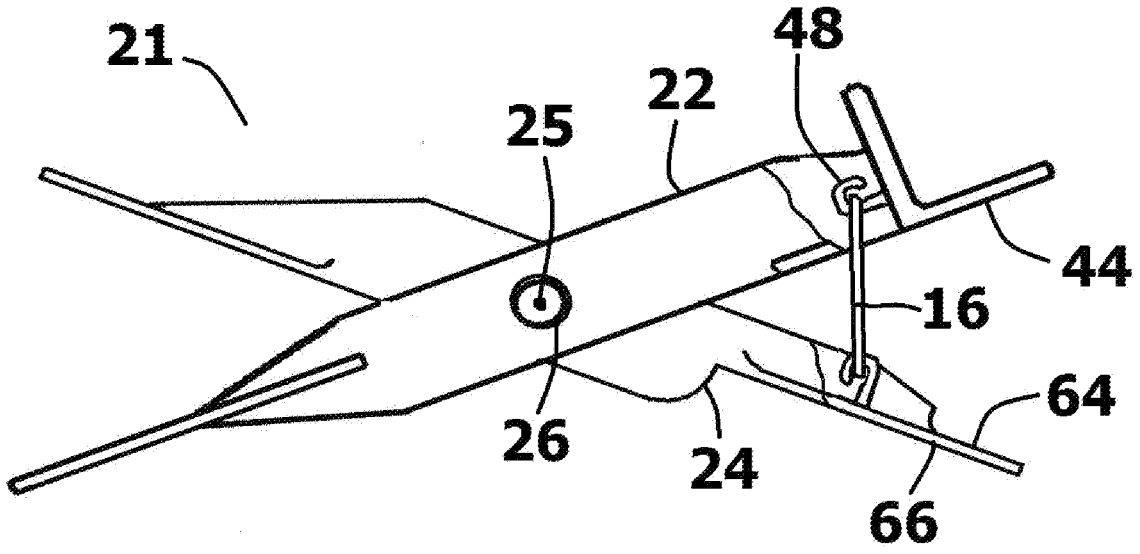
FIG. 7 is a cross-sectional view of the bi-stable assembly in its second stable configuration.

Referring to FIG. 7, in conjunction with FIGS. 3 through 6, it can be seen that the first segment 22 passes through the second open slot 50 of the second segment 24. As a consequence, the side walls 27, 28 of the first segment 22 are inside the side walls 47, 49 of the second segment 24. The pivot pins 40, 42 extending from the first segment 22 pass into the pivot holes 60, 61 on the second segment 24. This creates the scissor joint 26 between the first segment 22 and the second segment 24. The elastic band 16 engages both the first anchor hook 48 on the first segment 22 and the second anchor hook 66 on the second segment 24. The elastic band 16 rotates both the first segment 22 and the second segment 24 about the pivot axis 25 by biasing the first flange 44 on the first segment 22 toward the fourth flange 64 on the second segment 24.

It can be seen that in an uncocked second stable configuration 21, the elastic band 16 moves the first flange 44 of the first segment 22 toward the fourth flange 64 on the second segment 24 until the first flange 44 contacts the side walls 47, 49 of the second segment 24. This acts as a mechanical stop, wherein the overall bi-stable assembly 12 is positionally stable. In this second stable configuration 21, the elastic band 16 is only slightly stretched.

Figure 8:
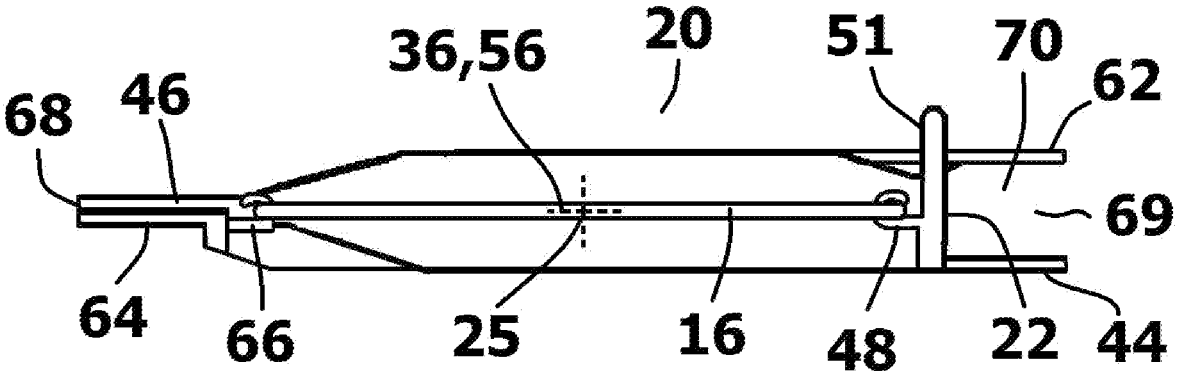
FIG. 8 is a cross-sectional view of the bi-stable assembly in its first stable configuration.

Referring to FIG. 8 in conjunction with FIG. 3 through FIG. 6, it can be seen that the first segment 22 and the second segment 24 can be rotated about the scissor joint 26 in opposition to the bias of the elastic band 16. The first flange 44 on the first segment 22 rotates toward the third flange 62 on the second segment 24. The rotation also causes the second flange 46 on the first segment 22 to rotate toward the fourth flange 64 on the second segment 24. When fully rotated to the shown cocked first stable configuration 20, the second flange 46 is between 1 degree and four degrees away from the fourth flange 64, therein providing the bi-stable assembly 12 with a cocked first end 68. In this first stable configuration 20, the midline 36 of the first segment 22, the midline 56 of the second segment 24, and the pivot axis 25 of scissor joint 26 are all aligned in a common plane. Furthermore, in this first stable configuration 20, the elastic band 16 is stretched taut between the first anchor hook 48 and the second anchor hook 66. The first anchor hook 48 and the second anchor hook 66 hold the stretched elastic band 16 in the same plane as the pivot axis 25 of the scissor joint 26. As such, the stretched elastic band 16 creates no torque forces around the scissor joint 26 and the bi-stable assembly 12 is stable with a stretched elastic band 16.

In the first stable configuration 20, the first flange 44 and the second flange 46 of the first segment 22 are parallel with, or with a few degrees of parallel with the third flange 62 and the fourth flange 64 of the second segment 24. The second flange 46 and the fourth flange 64 are adjacent to each other at the cocked first end 68. However, at the opposite cocked second end 69 of the bi-stable assembly 12, the first flange 44 and the third flange 62 are widely spaced apart. This forms a gap space 70 between the second flange 46 and the fourth flange 64. The presence of the gap space 70 on the cocked second end 69 and the lack of a gap space on the cocked first end 68 is important for positioning the multiple bi-stable assemblies 12 into a cascading formation.

Additionally, it can be seen that when the bi-stable assembly 12 is in its first configuration 20, the post 45 on the first segment 22 extends through and beyond the second segment 24.

Figure 9:
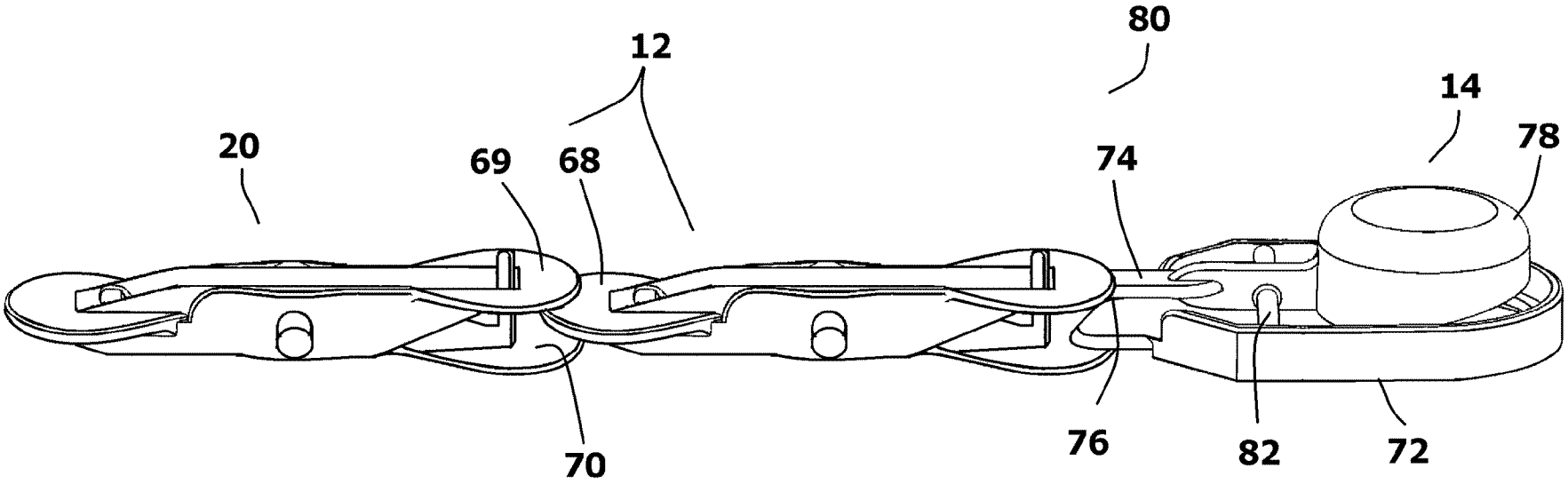
FIG. 9 shows the full jumping toy system arranged into a first cascading chain with the bi-stable assemblies in their first stable configurations.

Referring to FIG. 9 in conjunction with FIG. 1, multiple bi-stable assemblies 12 are shown in conjunction with the triggering mechanism 14. The triggering mechanism 14 consists of a base 72 with an elevated lever 74. The elevated lever 74 has a first end 76 and an opposite second end 78. The elevated lever 74 has a fulcrum 82. As a result, the first end 76 of the lever 74 rises when the second end 78 of the lever 74 is depressed.

To create a cascading chain 80, multiple bi-stable assemblies 12 are positioned into their cocked first stable configurations. As a result, each of the bi-stable assemblies 12 will have stretched elastic bands 16. Furthermore, each of the bi-stable assemblies 12 will have a cocked first end 68 with no gap space and a second cocked end 69 with a gap space 70. A plurality of bi-stable assemblies 12 are interpositioned. The cocked first end 68 of a first bi-stable assembly 12 is positioned into the gap space 70 at the second cocked end 69 of a subsequent bi-stable assembly 12. This process can be continued indefinitely to produce a cascading chain 80 of bi-stable assemblies 12. The cascading chain 80 will begin with the cocked first end 68 of a bi-stable assembly 12 and will end with the cocked second end 69 of a different bi-stable assembly 12 with any number of additional bi-stable assemblies 12 interposed therebetween.

Figure 10:
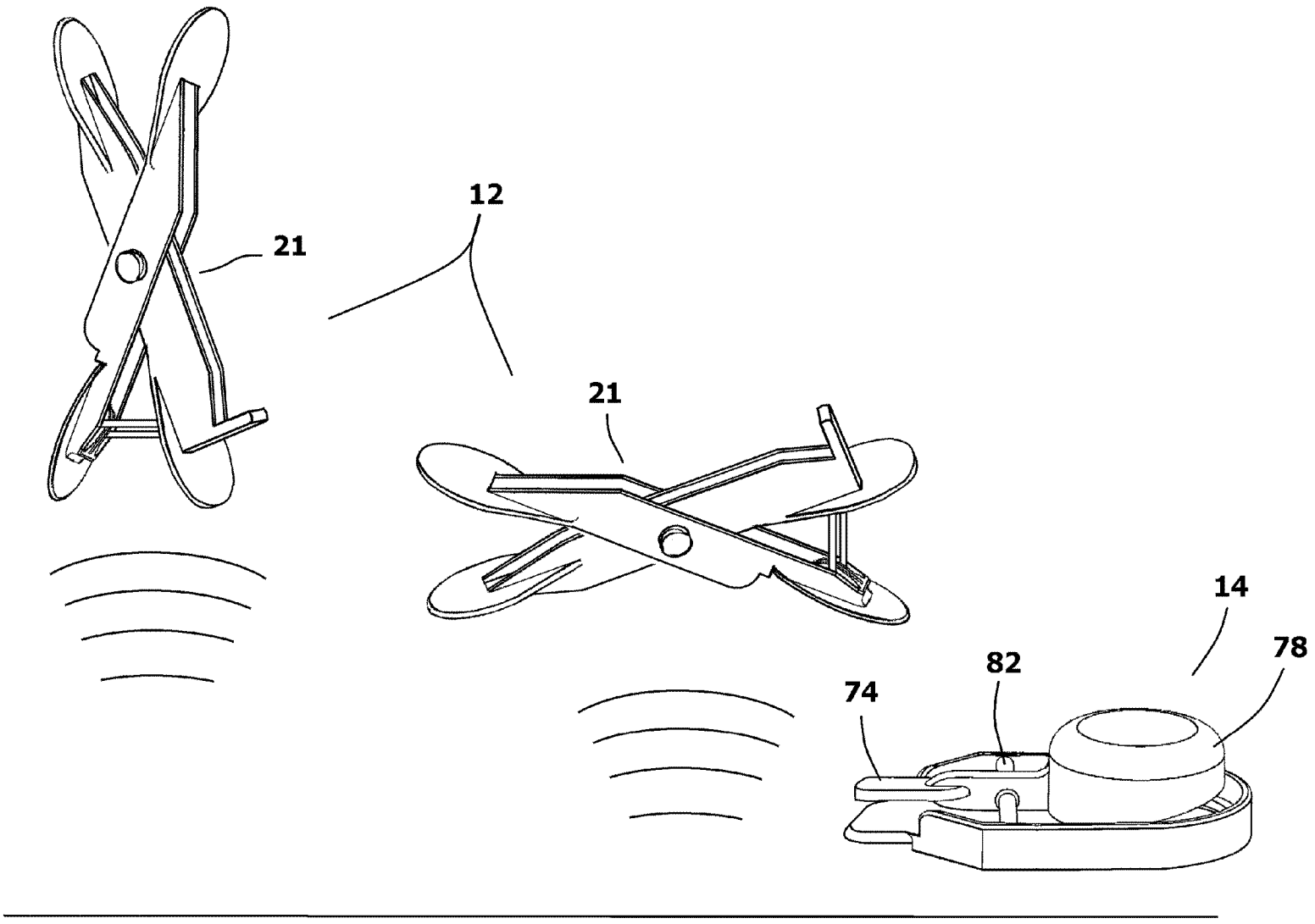
FIG. 10 shows the full jumping toy system of FIG. 9 with the bi-stable assemblies triggered to their second stable configurations.

The base 72 and the first end 76 of the lever 74 are inserted into the gap space 70 at one end of the cascading chain 80. To trigger the cascading chain 80, the second end 78 of the elevated lever 74 is depressed. The elevated lever 74 rocks about the fulcrum 82, wherein the first end 76 and the lever 74 spread. The base 72 and the first end 76 of the lever 74, spread the first flange 44 and the third flange 62 apart. The moment the first flange 44 and the third flange 62 move apart, the bi-stable assembly 12 leaves its cocked first stable configuration 20. The energy held in the stretched elastic band 16 is triggered and released. Referring to FIG. 10 in conjunction with FIG. 9, it will be understood that the elastic band 16 snaps the bi-stable assembly 12 into its uncocked second stable configuration 21. The rapid release of spring energy makes the bi-stable assembly 12 jump into the air as the first and second segments 22, 24 rotate and contact the ground. Furthermore, as the bi-stable assembly 12 moves from its first stable configuration 20 to its second stable configuration 21, the first flange 44 and the third flange 62 spread apart. This triggers the next subsequent bi-stable assembly 12 in the cascading chain 80. This cascading reaction repeats until all the bi-stable assemblies 12 in the cascading chain 80 have been triggered.

Figure 11:
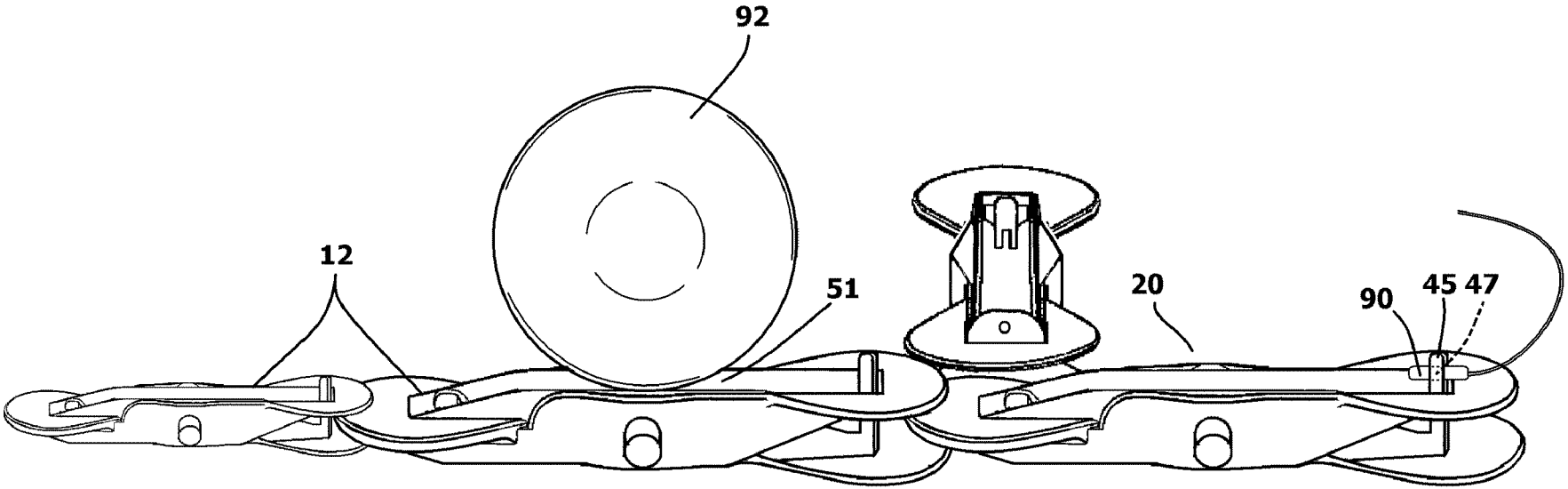
FIG. 11 shows the full jumping toy system arranged into a second cascading chain with the bi-stable assemblies in their first stable configurations and shown in conjunction with an auxiliary ball.
Figure 12:
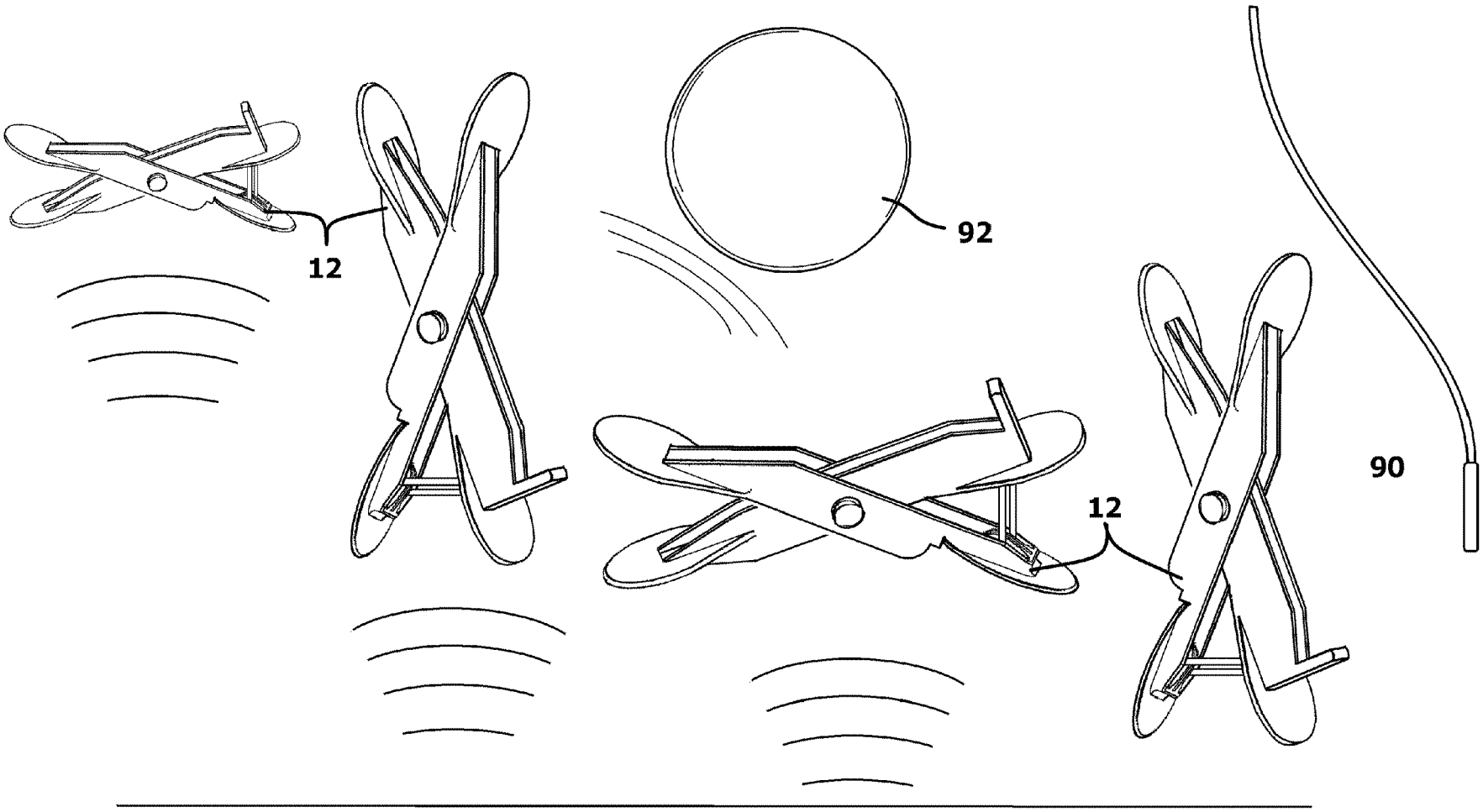
FIG. 12 shows the full jumping toy system of FIG. 11 with the bi-stable assemblies triggered to their second stable configurations.

Referring to FIG. 11 and FIG. 12, it can be seen that different cascade configurations can be used. Bi-stable assemblies 12 of different sizes can be interpositioned. Furthermore, multiple bi-stable assemblies can be triggered by a single bi-stable assembly, if desired.

Furthermore, a safety pin 90 can be placed through the hole 47 in the post 45 of the first segment 22. The presence of the safety pin 90 locks the bi-stable assembly 12 into its cocked first configuration 20. This enables the bi-stable assemblies 12 to be positioned and otherwise manipulated by a user without accidently triggering the bi-stable assembly 12. Once the bi-stable assemblies 12 are in place, the safety pins 90 can be removed.

FIG. 11 and FIG. 12 also show that a secondary object, such as a ball 92 can be placed atop the bi-stable assembly 12 when it is in its cocked first configuration 20. When the bi-stable assembly 12 triggers to its second configuration 21, the ball 92 is launched into the air as the bi-stable assembly 12 changes shape.

It will be understood that the embodiments of the present invention that are illustrated and described are merely exemplary and that a person skilled in the art can make many variations to those embodiments. For instance, the length, width and shape of the bi-stable assemblies can be altered in many ways. Furthermore, the bi-stable assemblies can be shaped to have the appearance of secondary objects, such as animals, insects or the like. All such embodiments are intended to be included within the scope of the present invention as defined by the claims.

What is claimed is:

1. A bi-stable jumping toy, comprising:

a first segment having a first end and a second end;

a second segment having a first end and a second end, wherein said first segment is joined to said second segment at a pivot joint that has a pivot axis, wherein said pivot axis bisects both said first segment and said second segment;

wherein said first segment and said second segment rotate about said pivot axis between a first configuration where said first segment and said second segment contact, and a second configuration where said first segment and said second segment contact;

an elastic band extending between said first segment and said second segment, wherein said elastic band biases said first segment and said second segment into said second configuration until said first segment and said second segment are rotated into said first configuration, wherein said elastic band is stretched across said pivot axis and provides no rotational bias about said pivot joint to either said first segment or said second segment.

2. The bi-stable jumping toy according to claim 1, further including a first hook on said first segment and a second hook on said second segment, wherein said elastic band is retained by said first hook and said second hook.

3. The bi-stable jumping toy according to claim 1, wherein a first flange is disposed at said first end of said first segment, a second flange is disposed at said second end of said first segment, a third flange is disposed at said first end of said second segment and a fourth flange is disposed at said second end of said second segment.

4. The bi-stable jumping toy according to claim 3, wherein said second flange and said fourth flange abut when said first segment and said second segment are in said first configuration.

5. The bi-stable jumping toy according to claim 4, wherein a gap space exists between said first flange and said third flange when said first segment and said second segment are in said first configuration.

6. The bi-stable jumping toy according to claim 5, wherein said gap space is wide enough to receive both said second flange and said fourth flange therein.

7. The bi-stable jumping toy according to claim 1, wherein said first segment and said second segment have equal lengths.

8. The bi-stable jumping toy according to claim 1, wherein said second segment contains an elongated slot.

9. The bi-stable jumping toy according to claim 8, wherein said first segment extends through said elongated slot in said second segment.

10. A cascading jumping toy system, comprising:

a plurality of bi-stable assemblies, each of said plurality of bi-stable assemblies containing two segments that are centrally joined by both a scissor joint and a spring element, wherein said two segments are stable in a first configuration and said spring element biases said two segments into a stable second configuration when moved from said first configuration, wherein when said plurality of bi-stable assemblies are in said first configuration, each of said plurality of bi-stable assemblies has a first end and an opposite second end, wherein said second end has a gap space sized to receive said first end for forming a cascading chain having a first bi-stable assembly and a last bi-stable assembly;

wherein said plurality of bi-stable assemblies are arranged in said cascading chain so that movement of said first bi-stable assembly from said first configuration to said second configuration automatically triggers transition of all of said plurality of bi-stable assemblies from said first configuration to said second configuration.

11. The system according to claim 10, further including a triggering mechanism for moving said first bi-stable assembly from said first configuration to said second configuration.

12. The system according to claim 10, wherein said scissor joint has a pivot axis, wherein said two segments rotate about said pivot axis between said first configuration and said second configuration.

13. The system according to claim 12, wherein said spring element is stretched across said pivot axis in said first configuration and provides no rotational bias about said pivot axis to either of said two segments.

14. A bi-stable jumping toy, comprising:

a first segment having a first end, a second end, a first flange disposed at said first end of said first segment, and a second flange disposed at said second end of said first segment;

a second segment having a first end, a second end, a third flange disposed at said first end of said second segment and a fourth flange disposed at said second end of said second segment, wherein said first segment is joined to said second segment at a pivot joint that has a pivot axis;

wherein said first segment and said second segment rotate about said pivot axis between a first configuration where said first segment and said second segment contact, and a second configuration where said first segment and said second segment contact;

wherein said second flange and said fourth flange abut when said first segment and said second segment are in said first configuration; and wherein a gap space exists between said first flange and said third flange when said first segment and said second segment are in said first configuration, said gap space being wide enough to receive both said second flange and said fourth flange therein;

an elastic band extending between said first segment and said second segment, wherein said elastic band biases said first segment and said second segment into said second configuration until said first segment and said second segment are rotated into said first configuration, wherein said elastic band is stretched across said pivot axis and provides no rotational bias about said pivot joint to either said first segment or said second segment.

15. The bi-stable jumping toy according to claim 14, wherein said first segment and said second segment have equal lengths.

16. The bi-stable jumping toy according to claim 14, wherein said pivot joint bisects both said first segment and said second segment.

17. The bi-stable jumping toy according to claim 14, wherein said second segment contains an elongated slot.

18. The bi-stable jumping toy according to claim 8, wherein said first segment extends through said elongated slot in said second segment.

* * * * *